US005104013A

United States Patent [19]

Hawley

[11] Patent Number: 5,104,013

[45] Date of Patent: Apr. 14, 1992

[54] CAULKING TUBE NOZZLE ADAPTOR ADJUSTABLE FOR DIFFERENT CAULK BEAD SIZES

[75] Inventor: Donald R. Hawley, Three Rivers, Mich.

[73] Assignee: Myro, Inc., Wis.

[21] Appl. No.: 598,857

[22] Filed: Oct. 15, 1990

[51] Int. Cl.[5] ..... B65D 5/72

[52] U.S. Cl. ..... 222/566; 222/568; 239/600

[58] Field of Search ..... 222/325-327, 222/566-568, 575; 239/390, 391, 397, 600; 285/332.1, 401, 403

[56] References Cited

U.S. PATENT DOCUMENTS

| | | | |
|---|---|---|---|
| 28,694 | 6/1860 | Smith | 239/600 X |
| 490,956 | 1/1893 | Franzen | 222/391 X |
| 2,012,846 | 8/1935 | Bentzen | 222/568 X |
| 2,330,034 | 9/1943 | Doodchenko | 239/391 X |
| 2,815,895 | 12/1957 | Reed | 222/568 |
| 3,058,632 | 10/1962 | Stremmel | 222/567 X |
| 3,439,839 | 4/1969 | Schumann et al. | 222/568 X |
| 3,448,896 | 6/1969 | Kobayashi et al. | 222/568 X |
| 4,258,884 | 3/1981 | Rogers | 239/390 |
| 4,382,530 | 5/1983 | Calisto | 222/567 |
| 4,957,225 | 9/1990 | Childers | 222/568 |
| 4,995,540 | 2/1991 | Colin et al. | 222/567 X |

*Primary Examiner*—Michael S. Huppert
*Assistant Examiner*—Gregory L. Huson

[57] ABSTRACT

An adaptor for a caulking tube nozzle, the adaptor including a reducing coupling having a large end secured to the caulking tube nozzle and a small end which is threaded, and a cap having threads for engagement with the threads of the small end of the coupling to thereby cap and seal caulking material within the coupling when the caulking tube is not in use. In one form the large end of the reducing coupling is internally threaded for self-tapping engagement with the caulking tube nozzle, and the small end is externally threaded for engagement with internal threads in the cap. In another form, the large end of the coupling is formed integrally with the end of the caulking tube.

5 Claims, 4 Drawing Sheets

CAULKING TUBE NOZZLE ADAPTOR ADJUSTABLE FOR DIFFERENT CAULK BEAD SIZES

SUMMARY OF THE INVENTION

This invention relates generally to caulking gun and tube assemblies, and more particularly to an adaptor for directing caulking material from a caulking tube nozzle to a work area or crevice to be filled.

Conventional caulking guns employ tubes or cartridges containing caulking compound or material. These tubes are often formed of molded plastic, in one-piece. Other tube types may be formed of cardboard, with a thin metal (i.e., tin) end crimped to the cardboard; then a tube nozzle, usually formed of molded plastic, is crimped to the tin end. In any event, the tubes include an integral tapered nozzle, usually formed of plastic, for discharge of the caulking material. Typically, the tube nozzle is severed by the caulk gun user to create an exit opening through which the caulking material may be extruded onto the work area. Once such a tube nozzle has been severed, the diameter of the nozzle opening for extrusion of caulking material becomes fixed, and use of the caulking gun results in extrusion of a bead of caulking material having approximately the same diameter as the tube opening.

A practical problem arises, however, when the gun user wishes to use the gun successively to fill crevices having different widths. In order to effectively use the caulking gun, it is essential that the bead of caulking material issuing from the tube nozzle be of approximately the same or slightly less diameter or width than the width of the crevice to be filled. Since a nozzle opening fixed in size produces only a single size caulking bead, this size may be too small or too large for other cracks or crevices to be filled.

Also if caulking should be interrupted before the tube is completely emptied of caulking compound, there is a tendency with conventional caulking tubes for the compound remaining in the partly used tube to harden inside the front end and nozzle of the tube. Then, the caulking material will no longer squeeze out when the gun is actuated. Sometimes, continued squeezing of the trigger of the caulking gun under these circumstances causes the tube to explode or split open along one side. To avoid this problem, attempts have been made to keep the compound inside the tube from drying by sealing out air by inserting a nail or screw into the nozzle or by covering it with tape. Such attempts have achieved only limited success, however, because of their awkwardness and inability to quickly and completely effect an air-tight seal.

It is a primary object of the present invention to provide a caulking tube nozzle adaptor having adjustable exit opening sizes for directing any of several different bead sizes of caulking material onto a work area or into a crevice to be filled.

It is also an object of the invention to provide a caulking tube nozzle adaptor which may be quickly and easily mounted in secure fashion upon a caulking tube nozzle without generally necessitating the use of tools. Another object of the invention is to provide a caulking tube nozzle adaptor which enables the user or work person to quickly switch between any of various selected caulk bead sizes, for different job applications, while using the same caulking tube and gun assembly.

Still another object of the invention is to provide a caulking nozzle adaptor in which provision is made for sealing any caulking material left in the nozzle or adaptor when it is not in use, thereby avoiding premature hardening or caking of the caulk material through exposure to the atmosphere. Another object is to provide a caulking nozzle adaptor which is easily removed from a caulking tube after use and then may be readily cleaned for re-use.

DETAILED DESCRIPTION OF THE INVENTION

Figure 1:
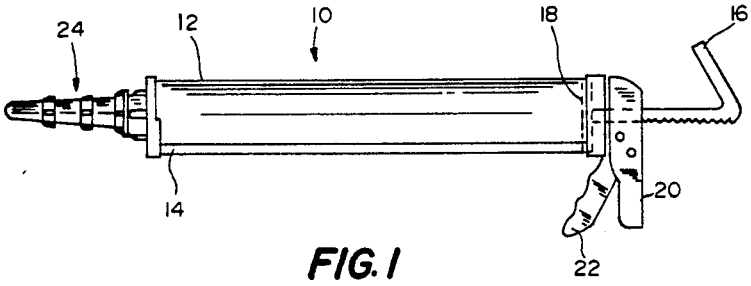
FIG. 1 is an elevational view of a typical caulking gun and tube assembly, including an illustrative adaptor incorporating the features of the invention described herein.

Turning now to the drawings, FIG. 1 shows a typical caulking gun 10 and tube 12 assembly with which the nozzle adaptor of the present invention is used. As shown, the caulking gun 10 includes a frame 14, a ratchet bar 16 having a pressure plate 18 fixed to one end, a handle 20 and a trigger 22. The tube 12 containing caulking material is placed within the gun frame 14. Typically, the tube or cartridge 12 includes an integral, tapered plastic nozzle 13 through which the caulking material or compound is extruded. To effectuate extrusion, the tapered nozzle 13 is severed (for example, using scissors or knife), to define an exit opening **13*a* through which an extruded bead of caulking material may pass. It may also be necessary to puncture any inner seal (not shown) provided within the nozzle, so that the caulking material may begin flowing. In use, the gun user grasps the gun handle 20 and squeezes the trigger 22. This operates a one-way pawl (not shown) to ratchet (see bar 16) the pressure plate 18 against the caulking material carried within the tube 12, causing a bead of caulking material to be extruded through the opening 13*a*** where it is ready for application to the work area.

in carrying out the invention, an illustrative nozzle adaptor 24 is provided which includes a reducing coupling 26, or a plurality of successively interconnected reducing couplings such as 26 and 28, or 26, 28 and 30, and an end cap 32. The end cap 32 is internally threaded and serves to seal the caulking material within the couplings and caulking tube from exposure to the atmosphere when the caulking gun and tube are not in use. All three reducing couplings, 26, 28, and 30 may be used together, or only the first coupling 26 by itself, or the first two couplings 26, 28 together, may be used depending on the bead size desired as explained further below.

Figure 2:
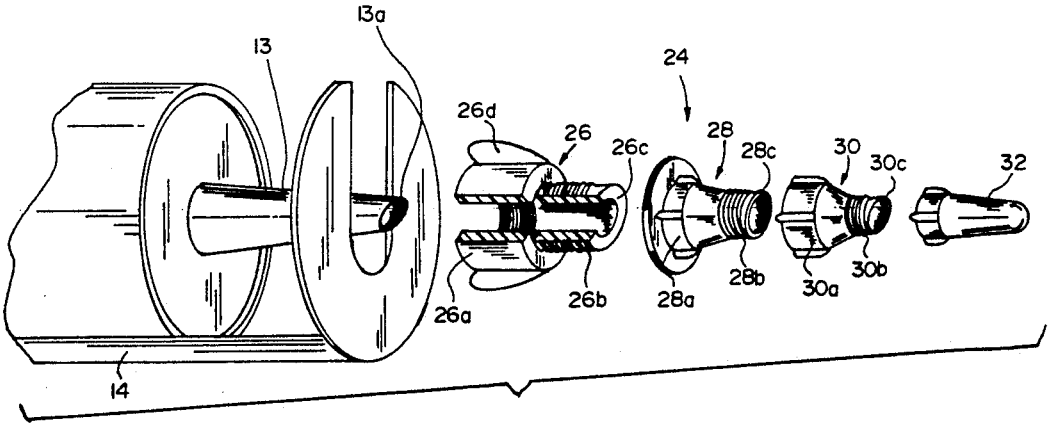
FIG. 2 is an exploded perspective view of an illustrative nozzle adaptor of the present invention, showing its relationship to the end portion of a typical caulking gun and tube assembly.
Figure 3:
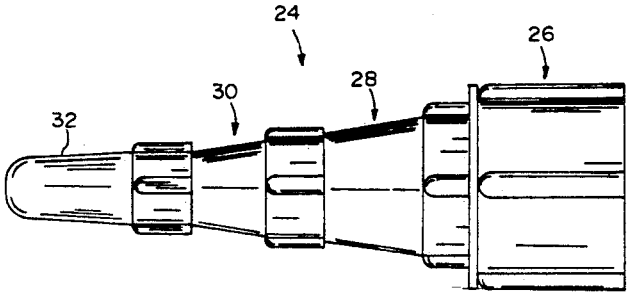
FIG. 3 is an enlarged elevational view of the illustrative nozzle adaptor of the present invention, showing the adaptor elements in their fully assembled relationship.
Figure 4:
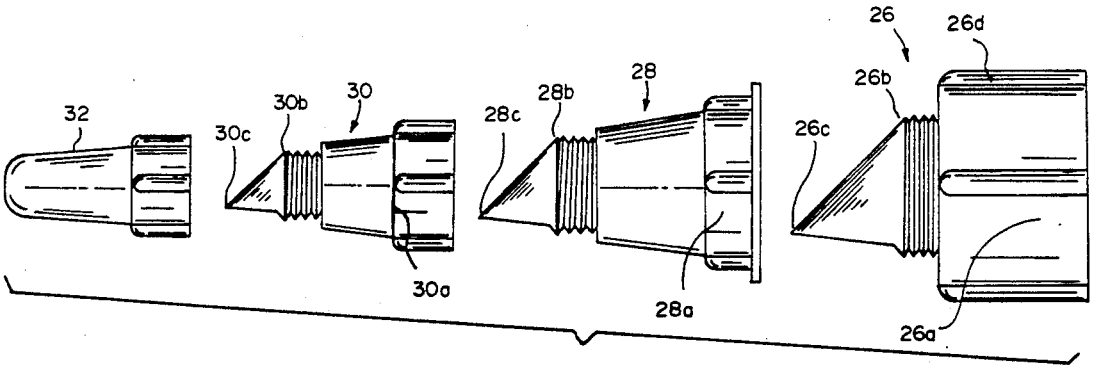
FIG. 4 is an enlarged exploded elevational view, showing the individual elements or portions of the illustrative adaptor of FIG. 3.
Figure 5:
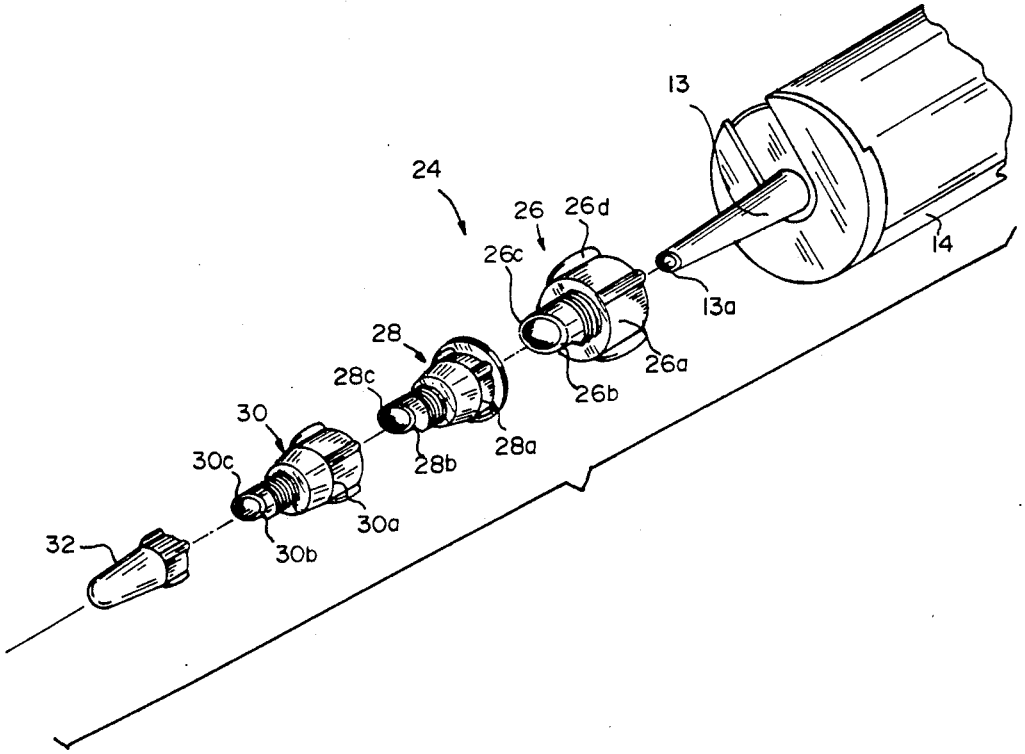
FIG. 5 is another exploded perspective view showing the various component portions of the illustrative nozzle adaptor of the present invention, and their relation to the caulking tube and gun assembly.

As shown in the drawings (especially FIGS. 2, 4, 5), the first reducing coupling 26 is provided with large 26*a* and small 26*b* ends. In keeping with one of the features of the invention, the large end 26*a* of the coupling 26 may be internally threaded for self-tapping engagement with the caulking tube nozzle 13. To effectuate this, the large end 26*a* is preferably formed of tough, hard material, such as high impact plastic, so that its internal threads will function to cut threads into the softer plastic of the tube nozzle 13. The small end 26*b* of the first coupling is externally threaded, and terminates in a tapered exit opening 26*c*. Suitable ribs or grippers 26*d* may be provided on the exterior of the large coupling end to facilitate the self tapping action.

The second reducing coupling 28 also has large 28*a* and small 28*b* ends. The large end 28*a* is internally threaded for engagement with the externally threaded small end 26*b* of the first coupling. The small end 28*b* is externally threaded, and terminates in a tapered exit opening 28*c*.

The third reducing coupling 30 likewise is provided with large 30*a* and small 30*b* ends. The large end 30*a* is internally threaded to receive the small end 28*b* of the second coupling. The small end 30*b* is externally threaded for engagement with the internal threads provided in the illustrative end cap 32.

The following is one exemplary use for the nozzle adaptor of the invention. A user or work person may wish, for example, to quickly caulk several window cracks of different widths, as well as a larger door crevice. In this instance, the illustrative nozzle adaptor may be sized so that the large end 26*a* of the first reducing coupling (which self-taps threads onto the cut tube nozzle 13) is about 1 inch in diameter, and its small end 26*b* about ½ inch in diameter. The second reducing coupling 28 may then be sized at ½ inch diameter at its large end 28*a*, and perhaps ¼ inch diameter at its small end 28*b*. And the third reducing coupling may, in this example, be sized at ¼ inch diameter at its large end 3-*a* and perhaps ⅛ inch diameter at its small end 30*b*. The end cap 32 would be correspondingly sized at ⅛inch.

Figure 6:
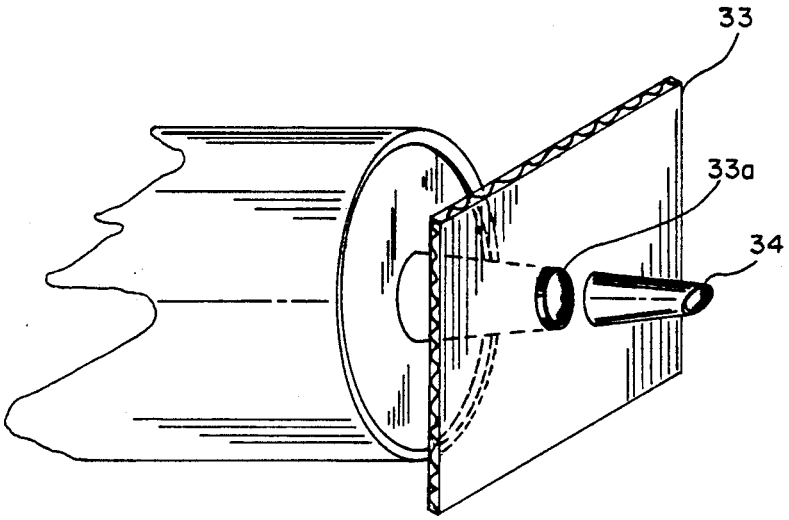
FIG. 6 is a perspective view of the nozzle end of an illustrative caulking tube which may be used in carrying out the invention showing the nozzle extending through a template point along the nozzle.

In this illustration, the work person would select a tube 12 of caulking material, place it in the gun 10, cut the tube nozzle 13 at the appropriate location (see FIG. 6), and then mount the adaptor assembly 24 on the tube nozzle by self-threading the large end 26*a* of the first coupling 26 onto the nozzle as described above. All of the adaptor 24 components, including the first 26, second 28 and third 30 reducing couplings, may be threaded together and mounted on the nozzle 13 as a unit.

To facilitate selection of the proper location along the tube nozzle 13 for the cut to be made, 1 provide a thin cardboard or plastic templatelike member 33 (see FIG. 6), having a central round opening 33*a*, for the worker to slip over the end of the tube nozzle. The diameter of the opening 33*a* may be selected to approximate the diameter of the tube nozzle 13 at the cut point. The worker then moves the member 33 along the nozzle 13 until the member reaches the point where it comes to rest (i.e., when the diameter of the opening 33*a* matches the outer diameter of the nozzle), and then cuts the nozzle at this point and discards its outer end 34.

Then, when the user wishes to fill a crevice, for example a door crevice approximately ½ inch wide, the user simply manually removes (by unthreading) the second and third couplings 28, 30 from the first coupling 26. Now the adaptor 24 consists of just the first reducing coupling 26, and as such presents an exit opening 26*c* of approximately ½ inch diameter. Now, by operation of the caulking gun (as described above), the user may force caulking material from the end of the tube 12, through the tube nozzle 13 and nozzle exit 13*a*, into the coupling 26, and out the exit opening 26*c* from whence the caulk bead may be directed to the crevice to be filled. In this instance, it is assumed that the crevice to be filled is approximately ½ inch in diameter.

Later, if the user wishes to fill smaller cracks, this is readily accomplished by attaching the the second reducing coupling 28 to coupling 26, by manually threading the large end 28*a* of the second coupling onto the externally threaded small end 26*b* of the first coupling. Now, the adaptor 24 includes both the first 26 and second 28 reducing couplings, and the diameter of the exit opening 28*b* for the caulking bead becomes ¼ inch. Thus, a ¼ inch bead will be produced by the caulking gun, and may be used for filling cracks of this approximate size.

Still later, the user may wish to further reduce the bead size. This may be accomplished by attaching the third reducing coupling 30 to the second coupling 28, by threading the large end 30*a* of the coupling 30 onto the small end 28*b* of the second coupling. Now, the adaptor 24 includes all three couplings, 26, 28, 30, and the size of the extruded caulking bead is ⅛ inch in diameter. This size bead is useful for filling small cracks or crevices.

When the user has finished work for the day, the cap 32 is threaded onto the small end 30*b* of the coupling 30 to thereby seal the fresh caulking material inside the adaptor and tube from exposure to the atmosphere. If, in the example above, the user wished to discontinue work after filling the large (i.e., ½ inch) crevice, sealing of the contents of the caulking tube could be accomplished by screwing the combination of cap 32, coupling 30, and coupling 28 onto the end 26*b* of the first coupling. In like manner, sealing could be accomplished if desired after filing the ¼ inch size cracks by screwing the cap 32 and coupling 30 onto the end 28*b* of the second coupling.

One of the features of my invention is that the worker has great flexibility in interrupting use of the caulking gun at intervals if necessary. For example, a worker using the caulking gun may be interrupted, and set the gun down to carry out some other duty. When the worker returns, and wishes to seal the nozzle, it may be advantageous for the worker to remove the adaptor from the nozzle, clean the adaptor of any caulking material that may have hardened within it, and then reinstall the adaptor and run fresh caulking material through the adaptor before securing the end cap in place. In other words, it may be advantageous for the worker to purge the adaptor before capping and sealing it.

Figure 7:
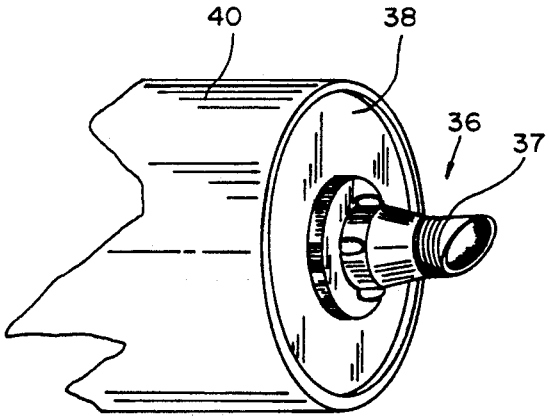
FIG. 7 is a perspective view of the nozzle end of a caulking tube illustrating an alternate form of my invention.

Various alternate forms of my invention may be used as well as those described above. For example, it may in a given application be feasible to utilize more than three reducing couplings, i.e., more than the couplings 26, 28, and 30 described above, and my adaptor should be understood to contemplate use of as many reduction stages as may be appropriate to accomplish the goal sought. Another alternative form of my invention is an arrangement in which the adaptor is molded or otherwise formed integrally with the caulking tube or tube nozzle, as shown in FIG. 7. As shown there, an illustrative adaptor coupling 36 is shown formed integrally with the end 38 of the caulking tube 40. The outer end 37 of the coupling 36 is provided with external threads, so that additional coupling members which are reduced in size like those shown in FIGS. 1–5, may be used as desired to reduce the caulking bead size emanating from the adaptor.

It will be seen that my invention described herein functions as a caulking assistant to the user or operator of a caulking gun. One of the features of my invention is that my adaptor in one form may be manually secured directly to a caulking tube nozzle by means of the self-tapping feature described herein. In another form, mg adaptor may be integrally formed with the caulking tube. Utilizing my invention, the caulking gun user has the ability to achieve different sizes of caulking bead through use of the various reducing couplings or extensions of the nozzle adaptor, which extensions may be quickly and easily threaded onto one another in succession as desired to arrive at a given bead size. My adaptor advantageously functions both as a nozzle and as a device for depositing the caulking material where desired.

I claim as my invention:

1. An adaptor for a caulking tube nozzle comprising, in combination, a reducing coupling, said reducing coupling including a first reducing portion comprising the large end of the coupling internally threaded for self-tapping engagement with the exterior surface of the caulking tube nozzle and having an externally threaded small end, a second reducing portion having a large end internally threaded for engagement with the externally threaded small end of the first reducing portion and having an externally threaded small end, and a third reducing portion having a large end internally threaded for engagement with the externally threaded small end of the second reducing portion and having an externally threaded small end comprising the small end of the coupling; and a cap having internal threads for engagement with the external threads of the small end of said coupling to thereby cap and seal caulking material within the coupling when the caulking tube is not in use.

2. An adaptor for the nozzle of a tube containing caulking material, comprising a member having a large open end threaded for self-tapping engagement with the caulking tube nozzle and a small end defining an exit opening through which a bead of caulking material may be extruded from the tube onto a work area, said adaptor including a series of consecutive, interconnected, reducing fittings, each stepped down in size from the preceding one, interposed between said large and small ends, and a cap which may be replaceably secured onto said small end to thereby seal caulking material within the caulking tube and nozzle when the tube is not in use.

3. An adaptor as defined in claim 2 in which the exit opening int he small end of the coupling is tapered.

4. An adaptor as defined in claim 2 having two reducing fittings.

5. An adaptor as defined in claim 2 having three reducing fittings.

* * * * *